United States Patent [19]

Nankee et al.

[11] Patent Number: 4,579,650

[45] Date of Patent: Apr. 1, 1986

[54] COAL ENHANCEMENT PROCESS AND EQUIPMENT

[75] Inventors: Robert J. Nankee; Thomas A. Vivian, both of Midland, Mich.

[73] Assignee: The Dow Chemical Company, Midland, Mich.

[21] Appl. No.: 717,200

[22] Filed: Mar. 28, 1985

Related U.S. Application Data

[63] Continuation-in-part of Ser. No. 567,434, Dec. 30, 1983, abandoned.

[51] Int. Cl.[4] ..... B03B 1/00

[52] U.S. Cl. ..... 209/11; 209/172; 203/96

[58] Field of Search ..... 34/9; 134/25.1, 40; 203/95, 96; 209/3, 10, 11, 17, 172

[56] References Cited

U.S. PATENT DOCUMENTS

| | | | |
|---|---|---|---|
| 3,347,370 | 10/1967 | Rampacek | 209/172 |
| 4,173,530 | 11/1979 | Smith et al. | 209/172 X |
| 4,198,289 | 4/1980 | Elliott et al. | 209/11 |
| 4,324,560 | 4/1982 | Fenseca | 209/172 X |

*Primary Examiner*—Charles Hart

*Attorney, Agent, or Firm*—Glwynn R. Baker

[57] ABSTRACT

A process for enhancing coal by removing the gangue (rock, shale, iron pyrites and the like) associated with the mined coal as it comes from the crushers before further treatment. The process described, slurries the crushed run of the mine (ROM) coal with a heavy medium, such as perchloroethylene, for a short period of time at ambient or below temperatures, (i.e. slurry times of 5–30 minutes and temperatures of 90° C. to below −10° C.); thereafter allowing, in a substantially quiescent environment, the solids to settle or float as their inherent densities are greater or lesser respectively than the density of the heavy medium. After settling the float solids (mostly coal of lower sulfur and ash content) are separated from the heavy medium as one stream and the sink solids (mostly the gangue) as a second stream. These solids are each washed with hot (90° C.–100° C.) water and the vapor azeotrope which forms from the water and heavy medium mixture (azeotrope) removed. The now water wet solids are separated from the body of hot water and sent for further processing or loading. The solids, both the coal and the gangue, have a heavy medium content of less than about 400 parts heavy medium per million parts solids.

3 Claims, No Drawings

COAL ENHANCEMENT PROCESS AND EQUIPMENT

CROSS REFERENCE TO THE RELATED APPLICATION

This application is a continuation-in-part of application Ser. No. 567,434 filed Dec. 30, 1983 and now abandoned.

BACKGROUND OF THE INVENTION

There are many patents and literature references, too numerous to mention, which disclose techniques as well as chemicals useful to separate coal from the gangue. The most widely used of these techniques employs the sink-float principle using magnitite as the heavy medium. The literature, however, teaches literally hundreds of compounds, most halogenated hydrocarbons, as equally useful.

So far the substitution of this later genus of compounds has not had much, if any, commercial success although several pilot plants are now running using perchloroethylene. One disadvantage associated with the use of this later class of compounds is that the coal retains a considerable amount of the halogenated compound and if not removed by stringent heating its retention, on burning, causes excessive corrosion in boilers and furnaces.

Representative of recent patents disclosing equipment employed in heavy media separations are U.S. Pat. Nos. 3,348,675, 2,150,917, 2,150,899, and 2,151,578. In addition, sales and promotional literature of Otisca and McNally show licensed processes.

BRIEF DESCRIPTION OF THE INVENTION

In accordance with the present invention a halogenated hydrocarbon the bromo chloro fluoro and mixed halogen hydrocarbons, particularly tetrachloroethylene (perchloroethylene), trichloroethylene, 1,1,1-trichloroethane (methylchloroform), or methylene chloride (dichloromethane) is slurried with a crushed (preferably 1/16 to ½ inch) run of the mine coal for a short period of time, usually from about 15 to 10 minutes, at temperatures of from about −10° C. to about 80°–90° C. The slurry is allowed to settle under substantially quiescent or mild agitation conditions. The coal rich particles will float free of the gangue rich particles which settle. Each body of settled and floated particles are removed for separate treatment. Following such separation, each body is independently treated with hot, 90°–100° C., water for a time sufficient to azeotrope off the separating liquid, i.e., the chlorinated solvent. Such treatment reduces the retained liquid to between about 100 parts to about 19000 parts liquid per million parts of coal. Many coals can be freed of solvent to less than 400 parts liquid per million parts coal usually in about ½ to 5 minutes contact. This is equivalent to less than 0.8 pound of liquid per ton of coal. Mild agitation may accompany the hot water treatment.

Representative results of processes which use steam or hot air show residual liquid in the order of 0.095% (950 ppm) at 180° F. steam; while oven heating for one hour at 100° C. leaves 0.655% (6550 ppm) liquid, at 175° C. 0.08% (800 ppm) or at 200° C. for one hour 0.02% (200 ppm) liquid retained compared to the 400 parts using only 98° C. water and only one minute contact in accordance with the present invention. Thus it is seen that, unexpectedly, the use of hot water vis-a-vis steam, hot air or ovens (kilns) removes more of the retained heavy media quicker than these prior art higher temperature processes. The invention allows essentially full recovery of the halogenated solvent. Both the steam and hot air (ovens) make it very difficult to have a good recovery of the halogenated because substantial amounts generally escape to ambient air. The ability to have a quick solvent removal is beneficial because the solvent may permiate the tars in a coal with time.

DETAILED DESCRIPTION OF THE INVENTION

EXAMPLE 1

To illustrate the effect hot water has on removing the heavy media from coal, 200 grams Aryshire coal, ROM, ½ inch to pan, about 3½% less than 100 mesh, was added to a liter of perchloroethylene with mixing for 5 minutes. Mixing was rapid but insufficient to attrite any appreciable amount of the coal. Following cessation of mixing the slurry was allowed to settle and about ¾ of the liquid, containing most of the coal, was separated and the liquid filtered away. This float filter cake portion, filtered free of the body of liquid perchloroethylene, was slurried into hot water at 99° C. The temperature dropped to between 88° C. and 93° C. due to mixing the wetted coal which was at ambient temperature, ca 23° C., with the hot water. Heat was applied to the container to maintain the temperature of the slurry at 88° C. and heating was continued until the slurry temperature rose to about 100° C. at which temperature about 10 cc of water substantially free of perchloroethylene was distilled over. Thereafter the coal was filtered free of the water and analyzed.

Analysis showed the coal had

| | |
|---|---|
| water | 9% |
| perchloroethylene | 1.3% |
| ash | 6% |
| sulfur | 3.4% |

The original coal had

| | |
|---|---|
| ash | 11.7% |
| sulfur | 4.5% |
| water | 6.3% |

The bottom portion (sink) of the sink float step treated in the same manner as the float had an analysis of

| | |
|---|---|
| ash | 42% |
| sulfur | 6.9% |
| perchloroethylene | 0.5% |

The above analysis illustrates that the hot water treatment effectively removes perchloroethylene from coal.

In comparison the same coal, treated by the same sink float technique using perchloroethylene as the heavy medium, when dried in a hot air convection oven at 120° C. air had a retained perchloroethylene content of 1.44% in the float portion after ½ hour, 1.10% after 1 hour, 0.96% after 2 hours, 0.86% after 3 hours and 0.68% after 4 hours.

EXAMPLE 2

Ayrshire coal, R.O M. from Amax, Ind. was processed by a sink float method in one of the following solvents then freed of residual solvent by the hot water treatment of Example 1. Comparison is also reported using the convection oven drying technique. The following table lists the results of the hot water heavy media removal technique:

| | Perchloro-ethylene | trichloro-ethylene | 1,1,1-trichloro-ethane |
|---|---|---|---|
| % solids in float | 82 | 71 | 64 |
| % solids in sink | 18 | 29 | 36 |
| % solvent in float solids | 1.5 | 1.8 | 1.8 |
| water temperature, °C. | 97 | 97 | 97 |
| time of slurry in hot water | 15 minutes | 15 minutes | 15 minutes |
| ppm solvent after hot water treatment | 1908 | 1675 | 1413 |
| % ash orig/float/sink | 11.7/5.9/41.9 | 11.7/4.9/38.6 | 11.7/2.7/21.6 |
| % sulfur orig/float/sink | 4.5/3.4/6.9 | 4.5/3.3/4.7 | 4.5/2.5/4.5 |
| Specific Gravity of Solvent, 25/25° C. | 1.62 | 1.32 | 1.46 |

Thus it is seen that the hot water treatment is equivalent to treatment with steam or hot air but equivalency can be achieved in shorter periods of time. The more important advantage is the ability to recover 99+% of the chlorinated solvent with the hot water treatment.

EXAMPLE 3

Cammeron Coal, R.O.M., Perma Mining, S.E. Colo., was processed by the sink float technique, the sink and float separated and each filtered to remove the solids with only retained solvent. The resulting cakes were each slurried in hot water to remove the residual solvent (heavy medium). The results employing different solvents as the heavy media are set forth below:

| | Perchloro-ethylene | 1,1,2-trichloro-ethylene | | | methylchloro-form |
|---|---|---|---|---|---|
| % sink/float | 2/98 | 6/94 | 6/94 | 44/56 | 20/80 |
| % solvent on float | | 6 | 1 | | |
| temperature, sink/float treatment | ambient | ambient | | 25° C. | −5°-0° C. |
| temperature hot water, °C. | 100 | 100 | 97 | 100 | 100 |
| time to dry, min. | 10 | 10 | ½ | 1 | 1 |
| % solvent remaining after hot water treatment (ppm) | 0.14 (1400 ppm) | 0.061 (614 ppm) | 0.042 (416 ppm) | — | <0.010 (<100 ppm) |
| % ash in orig. coal | 12–15 | 12–15 | 12–15 | | |
| % ash after hot water treatment in float | 8.72* | 8.35* | 8.52* | | 7.72* |

*pretreated ROM had an ash content of 12–15%

EXAMPLE 4: COMPARATIVE EXAMPLE

In a comparative run, the same coal treated by the sink/float technique using trichloroethylene was subjected to convection oven heating at 120° C. and measurements of residual solvent made at ½, 1, 2, 3, 4, and 8 hours. The results are set forth below.

| | |
|---|---|
| Original residual solvent content after filtering | 3.9% (38,275 ppm) |
| Solvent content after | |
| ½ hour | 262 ppm |
| 1 hour | 270 ppm |
| 2 hours | 263 ppm |
| 3 hours | 281 ppm |
| 4 hours | 172 ppm |
| 8 hours | 157 ppm |

Again, the ability of the hot bath treatment to recover 95–100% of the solvent in less than 10 minutes is shown where the oven treatment does not recover 90% of the solvent in a practical manner in less than ½ hour.

EXAMPLE 5

Rocky Mountain Energy Prospect Point Mine, labeled Leucite Hills, Wyo., 8+ mesh coal from ground and screened R.O.M. coal, was subjected to heavy media separation using perchloroethylene as the heavy media. The specific gravity of each screen aliquot of coal was measured and the float/sink from each screening filtered and the cakes subjected to the hot water treatment of the present invention the results obtained when the specific gravity varied are set forth below.

| (Specific gravity) | ROM | 1.6 | 1.5 | 1.4 | 1.3 |
|---|---|---|---|---|---|
| % sink/float | 0/100 | 1/99 | 3/97 | 22/78 | 30/70 |
| Desolventized Float | | | | | |
| % Ash | 8 | 8 | — | 3.9 | 3.3 |
| ppm residual solvent | — | — | — | 650 | 600 |
| Desolventized Sink | | | | | |
| ppm residual solvent | | | | 500 | 10 |

It is thus seen that in most instances the hot water treatment, water at or near its atmospheric boiling point, remove in shorter treatment periods more of the residual heavy medium halogenated solvent from the coal than the conventional steam, hot air or kilns.

We claim:

1. In a method for treating coal by the heavy media technique wherein the float and sink solids each individually are recovered and freed of liquid then dried to remove the residual heavy media retained thereon the improvement which comprises treating each solids portion with hot water at the temperature of from the heavy medium water azeotroping point to the boiling point of water for a time sufficient to remove a substantial portion of the heavy media or until the water comes off at its boiling point and thereafter separating the solids from the water.

2. In a method for treating coal by the heavy media technique wherein the float and sink solids each individually are recovered and freed of liquid then dried to remove the residual heavy media retained thereon the improvement which comprises treating each solids portion with hot water at from the temperature of the heavy medium water azeotroping point to the boiling point of water thereby to remove a substantial portion of the boiling media or until the water comes off at its boiling point, thereafter separating the solids from the water, and, recovering the media from the water/media vapors by condensation.

3. In a method for treating coal by the heavy media technique wherein the float and sink solids each individually are recovered and freed of liquid then dried to remove the residual heavy media retained thereon the improvement which comprises treating each solids portion with hot water at from the temperature of the heavy medium water azeotroping point to the boiling point of water to remove a substantial portion of the heavy media or until the water comes off at its boiling point, condensing said azeotrope to recover the media from the condensate, and separating the solids from the water.

* * * * *